US006257005B1

(12) United States Patent
Beatty

(10) Patent No.: US 6,257,005 B1
(45) Date of Patent: Jul. 10, 2001

(54) AIR CONDITIONER PRESSURE STATUS METER AND WARNING DEVICE

(76) Inventor: Scott Beatty, 10222 Loma Cir., Grosse Ile, MI (US) 48138

( * ) Notice: Subject to any disclaimer, the term of this patent is extended or adjusted under 35 U.S.C. 154(b) by 0 days.

(21) Appl. No.: 09/484,918

(22) Filed: Jan. 18, 2000

(51) Int. Cl.[7] ..... F25B 49/02
(52) U.S. Cl. ..... 62/129; 62/126
(58) Field of Search ..... 62/125, 126, 127, 62/129, 228.3, 158, 157, 231; 165/11.1; 236/94

(56) References Cited

U.S. PATENT DOCUMENTS 4,790,143 * 12/1988 Hanson ..... 62/126
5,209,076 * 5/1993 Kauffman et al. ..... 62/126
5,408,840 * 4/1995 Talley ..... 62/126
5,560,213 * 10/1996 Wieszt ..... 62/125

* cited by examiner

*Primary Examiner*—Harry B. Tanner

(57) ABSTRACT

A pressure status meter acts as an early warning/control device for an air conditioning system used in an automotive, industrial, or heavy equipment environment. The status meter measures the pressure at the condenser side of the air conditioning system and converts the measured pressure into a digital signal. If the signal crosses a predetermined threshold, the meter indicates a "caution" condition or a "shutdown" condition, depending on the severity of the high pressure condition. The device may also include a shutdown circuit that shuts down the air conditioning system if a shutdown condition is detected, preventing high pressure damage and potential freon leaks.

17 Claims, 3 Drawing Sheets

AIR CONDITIONER PRESSURE STATUS METER AND WARNING DEVICE

TECHNICAL FIELD

The present invention relates to an online diagnostic tool for air conditioning systems, and more particularly to an electronic early warning device for an air conditioning system used in automotive, industrial, or heavy equipment environments.

BACKGROUND OF THE INVENTION

Air conditioning systems in harsh environments, such as automotive, industrial trucking, or heavy equipment environments, may periodically experience high pressure conditions in the compressor and/or evaporator that could potentially damage air conditioning system components. Usually, these high pressure problems are discovered via diagnostic tools only after the air conditioning system has stopped operating due to the excessive pressure. However, breakdowns resulting from high pressure often require extensive repair, such as replacement of the condensor, evaporator, dryer, compressor and hoses. These repairs are both expensive and time-consuming, requiring extensive down time. Further, high pressure damage to the air conditioning system may cause freon to escape into the environment, which is undesirable due to freon's known detrimental effects on humans and the ozone layer.

Although there are devices that monitor the temperature of air conditioning systems during operation, there are currently no known online devices that monitor pressure during system operation. As a result, there is currently no known device that can provide early detection and warning of potentially damaging high pressure conditions.

There is a need for an online device that monitors the pressure in an air conditioning system during system operation and provides an early warning signal of potentially damaging pressures so that maintenance work can be performed on the system before a more serious system failure occurs.

SUMMARY OF THE INVENTION

Accordingly, a pressure status meter according to the present invention is an early warning device for an air conditioning system. More particularly, the invention monitors air conditioning systems in automotive/industrial trucking/heavy equipment environments by monitoring the system pressure and converting the pressure values into a digital signal using pressure activated switches. In one embodiment, the device monitors air flow through the air conditioning system's condenser and converts the data into a digital signal to indicate a particular system pressure condition, signaling the operator of the system that a problem either has occurred or may occur shortly.

DETAILED DESCRIPTION OF THE PREFERRED EMBODIMENTS

Figure 1:
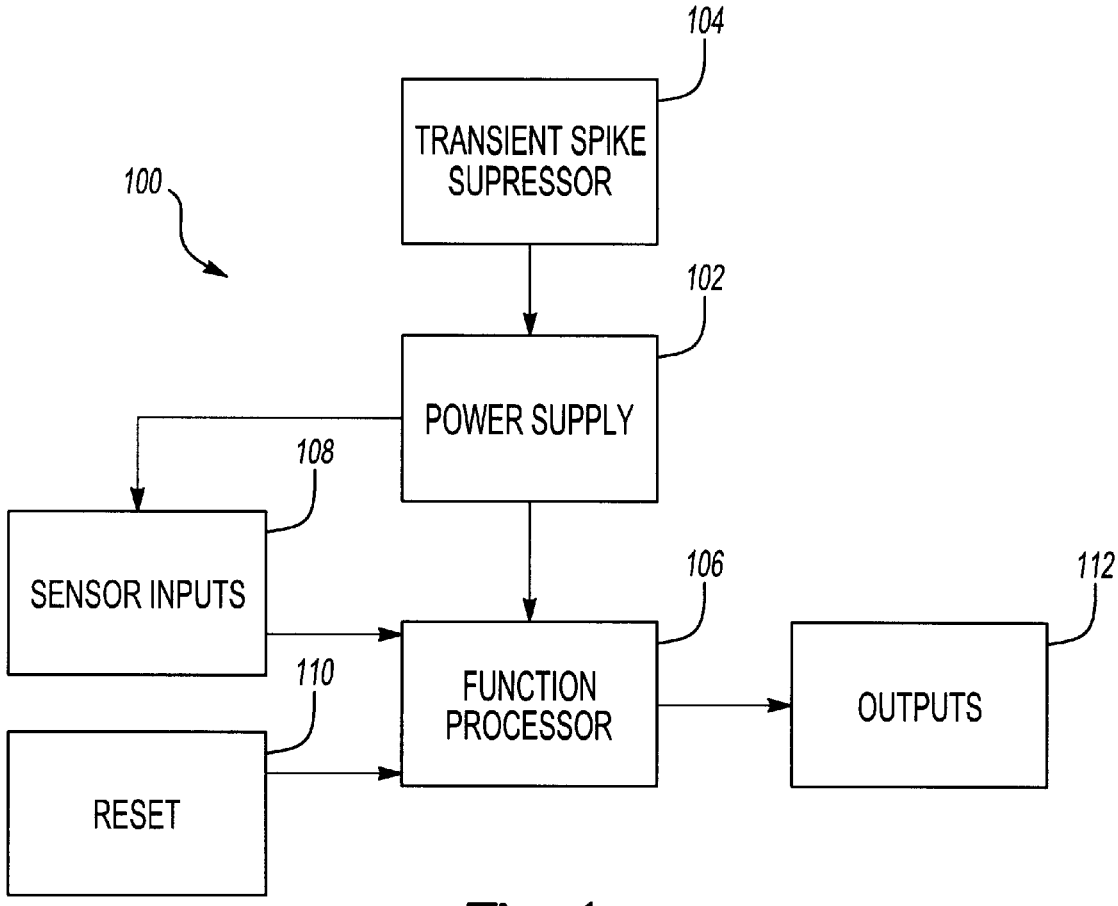
FIG. 1 is a block diagram illustrating the components of the inventive air conditioning system status meter.
Figure 2:
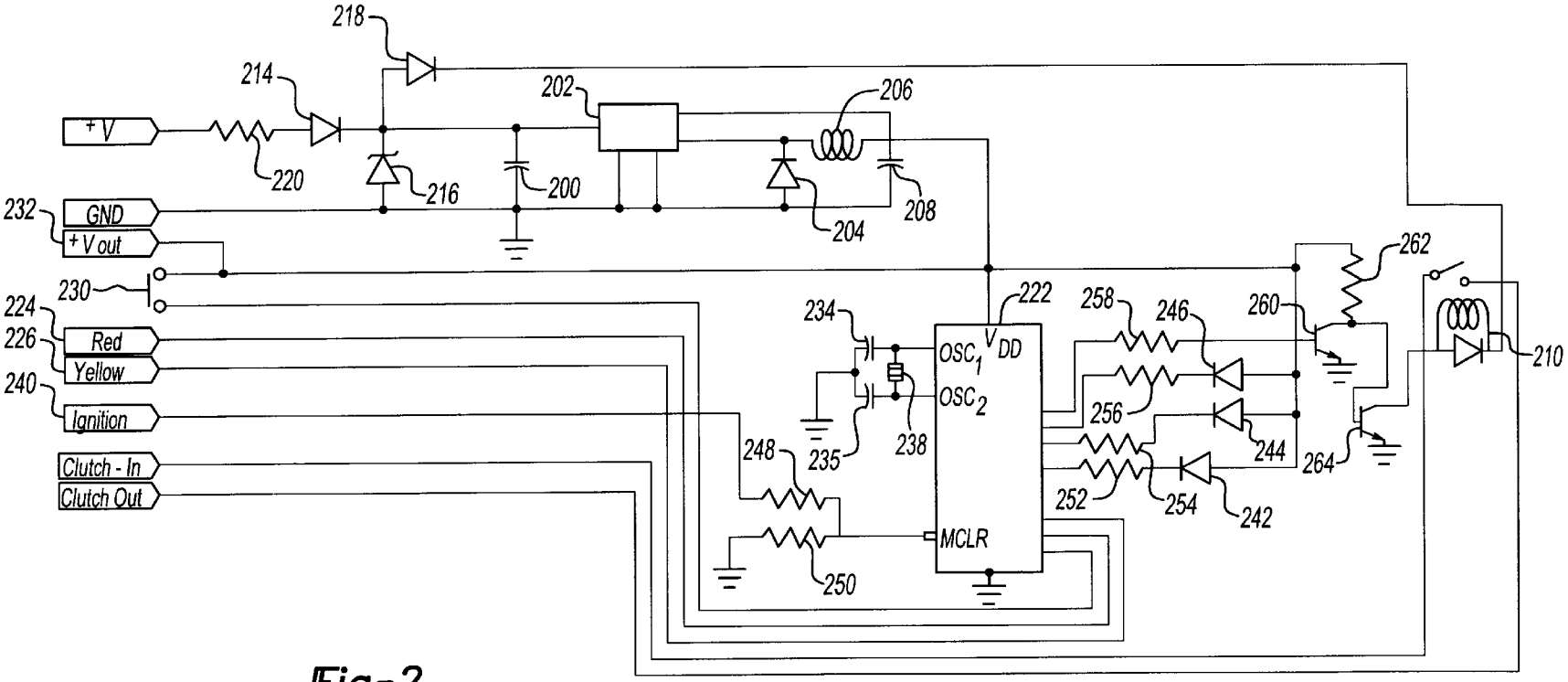
FIG. 2 is a schematic diagram of the inventive status meter.

FIG. 1 is a block diagram of one embodiment of a status meter for an air conditioning system according to the present invention, and FIG. 2 is a schematic diagram of the inventive status meter. The status meter 100 preferably includes five basic components: a power supply 102, an optional transient spike suppressor 104, a function processor 106, sensor inputs 108, a reset circuit 110 and outputs 112.

As illustrated in FIG. 2, the power supply 102 preferably includes an input capacitor 200, a switching regulator 202, a catch diode 204, an inductor 206 and an output capacitor 208. The input capacitor 200 is used to stabilize the circuit's operation by removing any low frequency oscillations. The catch diode 204 is preferably a zener diode and is used to provide a drain for over-voltage conditions. The output capacitor 206 together with the inductor 208 defines a dominant pole-pair of a switching regulator loop. The regulator 202, in conjunction with catch diode 204, inductor 208 and capacitor 206, produces a fixed 5V output which is used by all of the components in the status meter 100, except a relay 210, for proper operation.

Looking at the switching regulator 202 in more detail, pin 1 of the regulator 202 is an input, and pin 2 is an output and is connected to the catch diode 204 and inductor 208. Current passes through the inductor 206 to the rest of the circuit. Pin 4 of the switching regulator 202 is used for feedback and is connected to the inductor 208 and capacitor 206. Pins 3 and 5 of the switching regulator 202 is connected to the ground potential to allow the status meter 100 to stay active at all times.

The status meter 100 may include an optional transient spike suppressor 104, as indicated in FIG. 1, to prevent high voltage spikes from damaging the status meter 100. The transient spike suppressor 104 preferably contains resistor 212, diode 214, transorb 216 and diode 218. A 2.2 k ohm resistor 220 is preferably used as a current limiter and is often required when the invention is used in applications where only battery power is provided. Diodes 214 and 218 remove any passing counter electromotive force (CEMF) spikes or any other transient high voltage spikes occurring from the ground potential to the voltage source. The transorb 216 absorbs the voltage spikes and transfers them from the ground potential to the voltage source without allowing the spike to past through any other components, thereby removing the possibility of damage caused by CEMF spikes or any other transient high voltage spike.

The sensor inputs are two lines connected to the RA1 and RA2 pins of a microcontroller 222, which is a component of the function processor 106 and will be explained in more detail below. The sensor inputs use a 5V supply as a source to generate a 5V signal, which represents a logic 1, to indicate a particular pressure condition to the function processor 106. The signal source is preferably a 1 amp, 5V supply. Input lines 224 and 226 are connected to two known pressure switches, thermocouples, or pressure transducers (not shown), which allow the 5V signal from the signal source to pass through when the sensed pressure reaches a predetermined threshold in the switch, thermocouple, or transducer. For example, if the input line 226 passes the 5V signal, a logic 1 will appear on the RA2 input line of the microcontroller 222. This event will cause the microcontroller 222 to enter a yellow/caution condition and will activate a corresponding output 228. The yellow/caution condition corresponds to, for example, a moderately high pressure level indicating that the air conditioning system requires maintenance, such as condenser cleaning. Similarly, if the input line 224 passes the 5V signal, a logic 1 will appear on the RA1 input line of the microcontroller. This event will cause the microcontroller 222 to enter a red/shutdown condition. This condition will activate outputs RB2 and RB3. The red/shutdown condition corresponds to, for example, a pressure level that could potentially cause permanent system damage and/or could cause freon to escape.

The reset circuit 110 operates in much the same way as the input sensors 108. Switch 230 is a single pole single throw switch that uses supply line 232 to indicate a reset condition. A yellow/caution condition can be reset simply by, for example, turning off the ignition of the equipment being monitored and turning it back on. However, a red/shutdown condition is meant to be reset only after certified personnel have repaired the air conditioning system and used the reset circuit to reset the status meter 100 manually. After authorized service personnel have set the invention in reset mode, a logic 1 will appear on the RA0 input line of the microcontroller 222. The shutdown bit is then cleared by, for example, turning the ignition of the equipment being monitored off and then on again, to allow the air conditioning system to resume normal operation.

The function processor circuit 106 preferably contains the microcontroller 222, two capacitors 234, 236 and a crystal 238. The crystal 238 is a 4 MHz oscillator that provides the clock signal for the microcontroller 222. The two capacitors 234 and 236 keep the clock signal from the oscillator 238 free of any unwanted noise. The crystal 238 and capacitor 234 are connected to the OSC1 pin of the microcontroller 222. The crystal 238 and capacitor 236 are connected to the OSC2 pin of the microcontroller 222. Pins 15 and 16 of the microcontroller 222 are connected to the 5V supply and pins 5 and 6 of the microcontroller 222 are connected to the ground potential. Port A of the microcontroller 222 is defined in the software (shown in Appendix A) as an input port and port B is defined in the software as an output port. The red/shutdown pressure sensor is connected to RA1, the yellow/caution pressure sensor is connected to RA2 and the reset circuit is also connected to RA2. If a logic 1 signal is detected on any of these inputs, the corresponding pressure condition is determined by the software and the appropriate output is activated. In the green/reset mode, a logic 1 is placed on RB0 which activates the reset output. In the yellow/caution condition, the green/reset output is disabled and a logic 1 is placed on RB1. In the event of a red/shutdown condition, all outputs are disabled and a logic 1 is placed on RB2.

An ignition line 240 is an input that is used to suspend the microprocessor's 222 operation when the ignition/enable wire is turned off. This input deactivates status indicator lights 242 (green), 244 (yellow), 246 (red), the relay 210, the inputs 224, 226 and the switch 230. This input uses two resistors, 248 and 250, configured as a voltage divider and connected to the nMCLR input of the function processor 106. The indicator lights 242, 244, 246 are preferably LEDs or other lights that can withstand the operating environment of the status meter 100.

The outputs of the inventive status meter controlled by the microcontroller 222. The RB0 output is the green/reset output. During normal operation of the air conditioning system, there is a logic 0 present on the green/reset output and a logic 1 present at the RB3 output. Resistor 252 limits the current passing through the green indicator light 242.

The RB1 output controls the yellow/caution indicator light 38. When a caution state is detected at the input line 226, the microcontroller 222 places a logic 0 at the RB1 output, turning on the yellow indicator light 244, and then places a logic 1 on the RB0 output, turning the green indicator light 242 off. Resistor 254 limits the current passing through the yellow indicator light 244.

The RB2 output controls the red/shutdown output. When a logic 1 is detected at the red/shutdown input line 224, outputs RB0 and RB1 are set high and a logic 0 is placed on the RB2 output and RB3 output. This event activates the red indicator light 246 and deactivates the relay 210. Resistor 256 limits the current passing through the red indicator light 244. All of the indicator lights 242, 244 and 246 receive power from the power supply 102 and have their ground potentials controlled by the microcontroller 222. Resistor 258 is used to limit current to transistor 260. Resistor 262 limits the current through the relay coil 210, and transistor 260 controls the ground potential for the relay 210.

The relay 210 controls the power to the clutch of the air conditioning system's compressor. The normally open contacts in the relay 210 are closed when the system is operating normally to ensure that the system shuts down if the inventive status meter loses power. When the relay 210 is deactivated, the power to the compressor in the air conditioning system is severed, shutting down the system.

Figure 3:
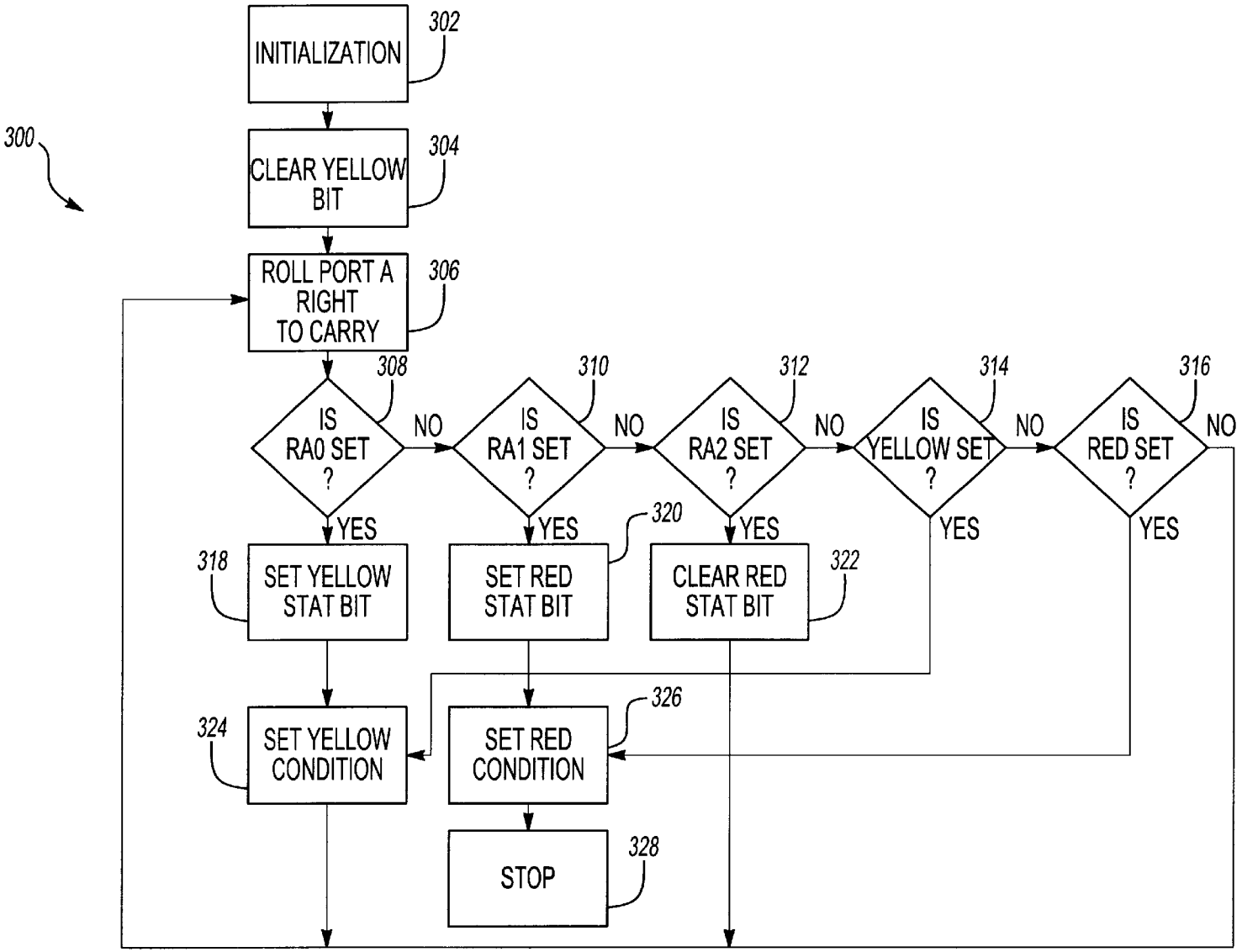
FIG. 3 is a flowchart describing the process through which a microcontroller in the inventive status meter detects caution and warning conditions.

FIG. 3 is a flowchart illustrating a routine that could be executed by the microprocessor 222 in the inventive status meter. An example of the specific code that can be used by the microcontroller 222 to perform the required functions of the invention is provided in Appendix A. The routine begins with an initialization routine 300, which provides the microcontroller 222 with a processor list file all of the processor's functions and provides the interruptible mask assignments (IMAs) and tells the microprocessor 222 where to start looking for the beginning of the code. The initialization routine 300 starts by defining memory locations for the TEMP, STAT_YELLOW and STAT_RED variables. The ORG instruction starts the program at address 0, the TEMP and STAT_YELLOW variables are cleared and the NOP instruction is used to space the code apart. The TRIS instruction is used to define a port as an output or input. A logic 1 sets a port line as input and a logic 0 sets a port line as output. An h0F is used to set portA as input and an h00 is used to set portB as output. Finally, an h0E is moved to portB to activate the relay 210 and the green indicator lights 242.

The routine then proceeds to steps 302 and 304, which includes reading portA until a particular pressure condition is detected. At steps 306 through 316, the status of the STAT_RED and STAT_YELLOW bits are checked to see if a condition has been previously detected. More particularly, the input routine starts by moving the data on portA to the W register and then to the TEMP register. The data in the TEMP register is then rotated bit-by-bit into the C flag of the STATUS register. Each time a bit is rotated, the C flag is tested for a set condition. If the C flag is clear, the following line of code is skipped, if the C flag is set, the following line of code is executed. If RA2 is set, the code goes to the CAUTION routine, if RA1 is set, the code goes to the SHUTDOWN routine, and if RA0 is set, the code goes to the CLEAR_RED routine. If none of the input lines are set, the code will check the status of the STAT_RED and STAT_YELLOW registers. If STAT_RED is set, the code goes to the SHUTDOWN routine, and if the STAT_YELLOW register is set, the code goes to the CAUTION routine. Finally, if none of the conditions are set, the code places an h0E on portB and returns to the top of the input routine to start the process again.

The CLEAR_RED routine resets the STAT_RED register if the reset switch is closed and returns to the top of the INPUT routine. The CAUTION routine placed an h0D on portB to deactivate the green indicator light 242 and activate the yellow indicator light 244. This routine then sets the STAT_YELLOW register and returns the top of the INPUT routine. The SHUTDOWN routine will place an h03 on portB to activate the red indicator light 246 and deactivate the green indicator light 242 and the yellow indicator light 244 as well as the relay 210. The routine described in FIG.

4 and the example shown in Appendix A will not return to the top of the INPUT routine, rendering the air conditioning system permanently shut down until authorized personnel can fix the air conditioning system and reset the status meter 100. This protects the air conditioning system from damage caused by high pressures and prevents freon from leaking from the system.

In summary, when the air conditioning system's condenser becomes impaired, pressures within the system rise to a level that can irreparably damage the air conditioning system's compressor and/or allow freon leaks. The invention detects any pressure increases and indicates by illuminating the yellow LED, that the condenser requires maintenance. If the system pressure rises even higher to a level that could potentially cause permanent damage, the invention shuts down the system altogether.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A pressure status meter for an air conditioning system, comprising:

a first pressure sensor that generates a first pressure signal when a first pressure condition is detected, wherein the first pressure condition is a caution condition where the pressure reaches a first threshold; a second pressure sensor that generates a second pressure signal when a second pressure condition is detected, wherein the second pressure condition is a shutdown condition where the pressure reaches a second threshold higher than the first threshold;

a function processor connected to said at least one pressure sensor, the function processor including:

a microcontroller having first and second input ports and first and second output ports corresponding with said first and second pressure sensors, respectively; and a clock signal generator that provides a clock signal to the microcontroller, wherein the microcontroller sends an output signal through the output port corresponding to the pressured condition sensed by the first and second pressure sensors; and first and second pressure status indicators responsive to the output signal from the microcontroller to indicate the first and second pressure conditions, respectively.

2. The pressure status meter of claim 1, further comprising a third pressure status indicator corresponding to normal operation of the air conditioning system.

3. The pressure status meter of claim 1, further comprising a shutdown mechanism that shuts down the air conditioning system if the second pressure condition is detected.

4. The pressure status meter of claim 3, wherein the shutdown mechanism comprises a relay that disconnects a component of the air conditioning system from a power supply.

5. The pressure status meter of claim 1, further comprising a shutdown mechanism that shuts down the air conditioning system when the predetermined pressure condition occurs.

6. The pressure status meter of claim 5, wherein the shutdown mechanism comprises a relay that disconnects a component of the air conditioning system from a power supply.

7. The pressure status meter of claim 1, further comprising a reset circuit that resets the status meter after the pressure condition has been sensed.

8. The pressure status meter of claim 7, wherein the reset circuit is a manual reset circuit that is actuatable by a user after the air conditioning system has been serviced.

9. The pressure status meter of claim 7, wherein the reset circuit includes a first reset mechanism for resetting the air conditioning system after a first pressure condition and a second reset mechanism for resetting the air conditioning system after a second pressure condition, wherein the second reset mechanism is a manual reset circuit that is actuatable by a user after the air conditioning system has been serviced.

10. The pressure status meter of claim 1, wherein the pressure signal is a digital signal that changes states if the predetermined pressure condition is detected.

11. A pressure status meter for an air conditioning system, comprising:

first and second pressure sensors coupled to the air conditioning system, the first pressure sensor generating a first pressure signal, indicating a caution condition, if the air conditioning system pressure reaches a first threshold and the second pressure sensor generating a second pressure signal, indicating a shutdown condition, if the air conditioning system reaches a second threshold higher than the first threshold;

a function processor connected to the first and second pressure sensors, the function processor including:

a microcontroller having first and second input ports for receiving the first and second pressure signals, respectively, and having first and second output ports associated with said first and second input ports, respectively; and a clock signal generator that provides a clock signal to the microcontroller, wherein the microcontroller sends an output signal through the first or second output port in response to the first or second pressure signal, respectively;

first and second pressure status indicators responsive to the output signal from the microcontroller to indicate the caution and shutdown condition, respectively; and a shutdown mechanism that shuts down the air conditioning system if the shutdown condition is detected.

12. The pressure status meter of claim 11, wherein the shutdown mechanism comprises a relay that disconnects a component of the air conditioning system from a power supply.

13. The pressure status meter of claim 11, further comprising a reset circuit that resets the status meter after the caution condition or the shutdown condition has been sensed.

14. The pressure status meter of claim 11, wherein the reset circuit includes a first reset mechanism for resetting the air conditioning system after the caution condition and a second reset mechanism for resetting the air conditioning system after the shutdown condition, wherein the second reset mechanism is a manual reset that is actuatable by a user after the air conditioning system has been serviced.

15. The pressure status meter of claim 11, wherein the first and second pressure signals are digital signals that change states if the first or second pressure condition is detected.

16. The pressure status meter of claim 11, wherein the first and second status indicators are LEDs coupled to the microcontroller.

17. The pressure status meter of claim 11, further comprising a third status indicator corresponding to a normal air conditioning system operating condition.

* * * * *